US005411203A

United States Patent [19]

Bochet et al.

[11] Patent Number: 5,411,203

[45] Date of Patent: May 2, 1995

[54] STAND-UP TYPE SACHET INTENDED TO CONTAIN A LIQUID, PASTY OR PULVERULENT PRODUCT

[75] Inventors: Thierry Bochet, Pontchateau; Jean-Pierre Moriniere, Bouzielle, both of France

[73] Assignee: Packart Holding, France

[21] Appl. No.: 282,725

[22] Filed: Jul. 29, 1994

Related U.S. Application Data

[62] Division of Ser. No. 861,795, Sep. 22, 1992, Pat. No. 5,356,069.

[51] Int. Cl.[6] ..... B65D 5/42; B65D 3/26

[52] U.S. Cl. ..... 229/104; 229/116.1; 229/193; 383/104; 493/167; 493/171; 493/174; 493/252

[58] Field of Search ..... 229/198.2, 116.1, 104, 229/193; 383/121.1, 104, 122; 493/167, 168, 171, 174, 252–254, 455–457

[56] References Cited

U.S. PATENT DOCUMENTS

| | | | |
|---|---|---|---|
| 2,015,413 | 9/1935 | Snyder | 229/193 |
| 2,232,088 | 2/1941 | Waters | 229/104 |
| 2,323,287 | 7/1943 | Amberg | 229/193 |
| 2,936,940 | 5/1960 | Berghgracht | 229/116.1 |
| 2,959,110 | 11/1960 | Thoma | 493/167 |
| 3,004,696 | 10/1961 | McCormick | 229/110 |
| 3,380,646 | 4/1968 | Doyen et al. | 383/104 |
| 3,405,859 | 10/1968 | Phillips, Jr. | 229/116.1 |
| 3,437,258 | 4/1969 | Kugler | 383/122 |
| 3,586,232 | 6/1971 | Scully | 229/104 |
| 3,998,378 | 12/1976 | Vetten | 229/193 |
| 4,010,676 | 3/1977 | Eilenberg et al. | 493/167 |
| 4,020,988 | 5/1977 | Kipp | 229/104 |
| 4,194,676 | 3/1980 | Humphries | 229/193 |
| 4,252,052 | 2/1981 | Meyers et al. | 493/167 |
| 4,981,257 | 1/1991 | Radbruch | 229/193 |
| 5,356,069 | 10/1994 | Bochet et al. | 229/104 |

FOREIGN PATENT DOCUMENTS

| | | | |
|---|---|---|---|
| 534852 | 10/1958 | Belgium . | |
| 538036 | 7/1959 | Belgium | 383/122 |
| 82209 | 6/1983 | European Pat. Off. | 493/167 |
| 492072 | 6/1919 | France | 493/167 |
| 2277737 | 2/1976 | France . | |
| 2417440 | 9/1979 | France . | |
| 365334 | 12/1922 | Germany | 493/167 |
| 2432935 | 1/1976 | Germany | 383/122 |
| 395719 | 12/1965 | Switzerland . | |
| 783024 | 12/1957 | United Kingdom . | |
| 1448444 | 9/1976 | United Kingdom . | |
| 9007455 | 7/1990 | WIPO . | |

*Primary Examiner*—Gary E. Elkins

*Attorney, Agent, or Firm*—Lerner, David, Littenberg, Krumholz & Mentilik

[57] ABSTRACT

Bag of the type obtained from a single elongate planar cutting presenting two parallel long edges with the cutting being backfolded in order to define the two faces of the bag. The faces meet at a transverse bottom formed by the medial portion of the cutting and the two faces of the bag are joined edge to edge by their two long edges and the small side opposite to the bottom. The bag is characterized in that the bottom is comprised of two triangular facets which are opposite back to back from the central region of the bottom and the two triangular facets are bent back towards the internal volume of the bag. The apex of the triangle is oriented toward the outside and meets the corresponding long edge of the bag. Each long edge of the bag is formed by edge joining of the two faces and comprises, in the zone between the triangle apex and the bag base, four thicknesses or layers from the initial cutting, sealed to each other. The two internal layers sealed to each other are slightly set back towards the inside thereby leaving an edge zone defined by the two external layers which are thus in contact with each other and sealed to each other beyond the terminal edge of the two internal layers to provide sealling and homogeneity of the bag.

14 Claims, 14 Drawing Sheets fig 1a
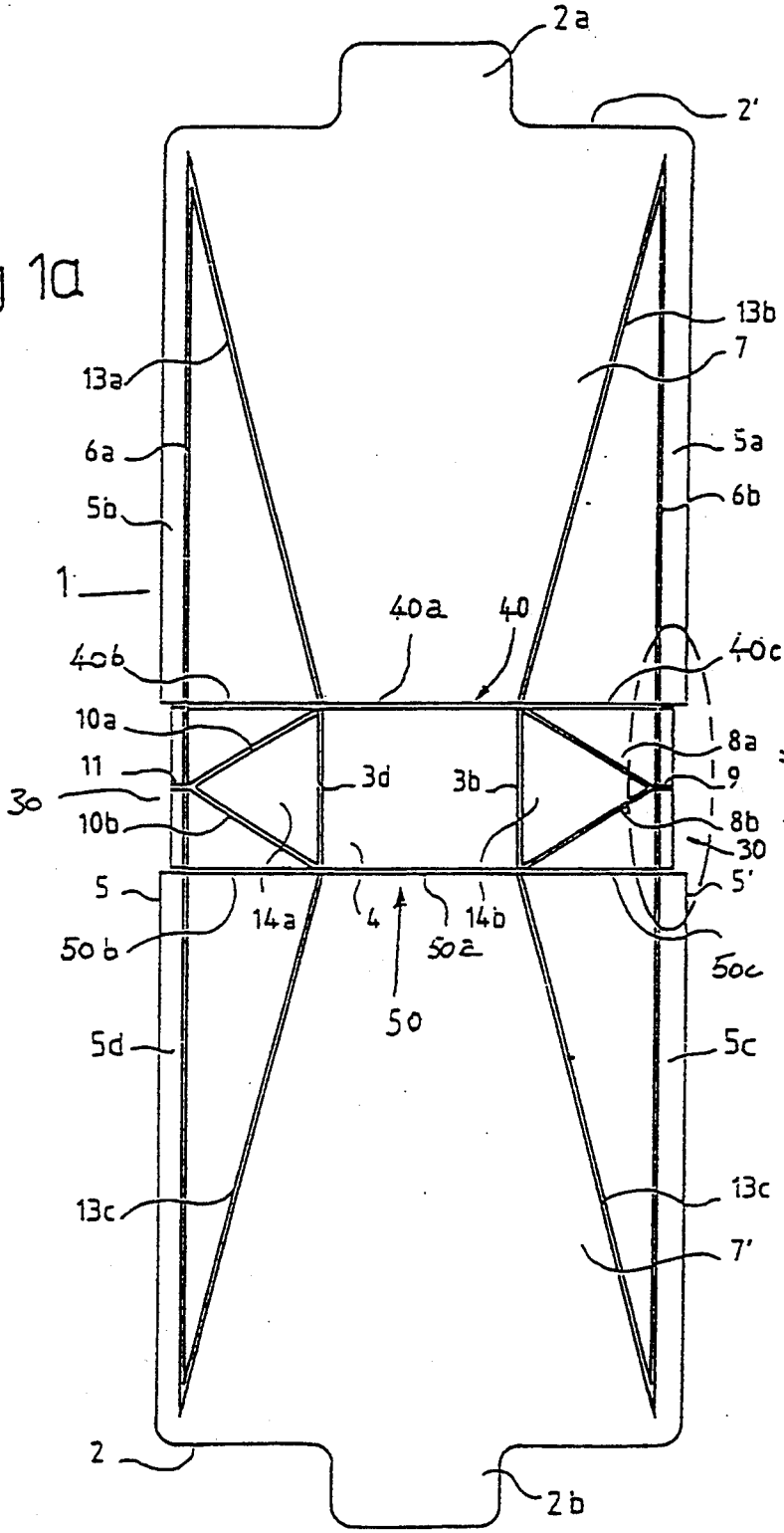
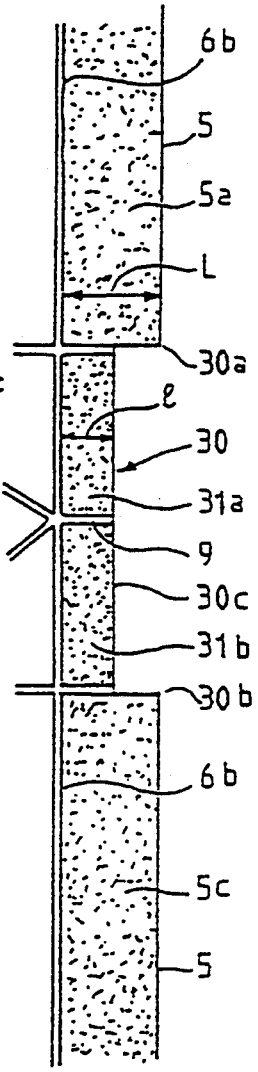
fig 1b

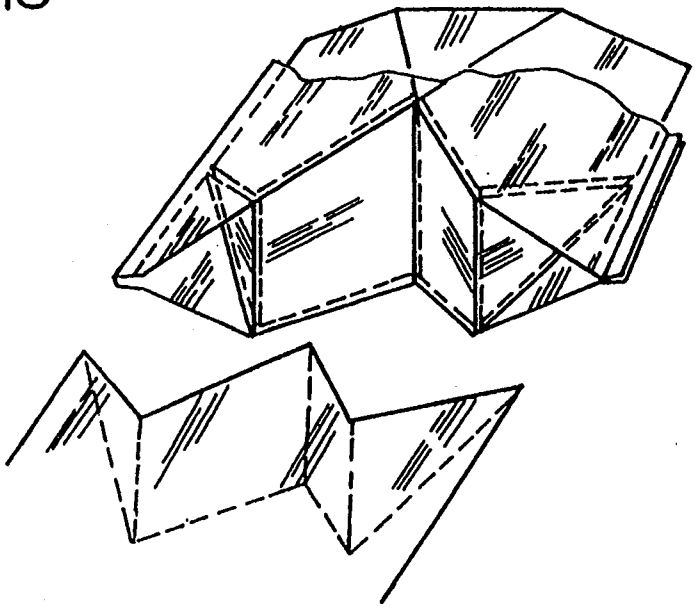
fig 14
fig 13
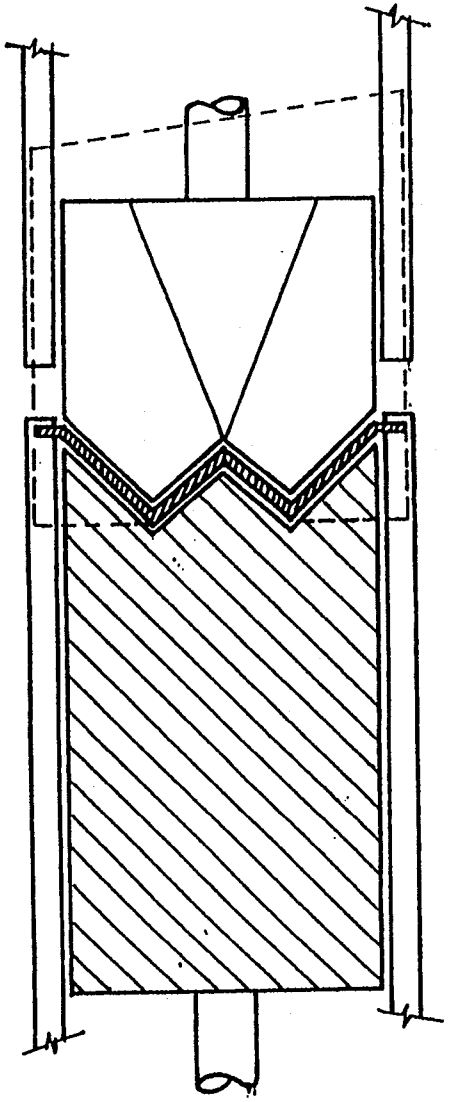

STAND-UP TYPE SACHET INTENDED TO CONTAIN A LIQUID, PASTY OR PULVERULENT PRODUCT

This is a division of application U.S. Ser. No. 07/861,795 filed Sep. 22, 1992, now U.S. Pat. No. 5,356,069.

The present invention relates to the domain of sachets intended to contain a unitary dose of a liquid, pasty or pulverulent product.

And the invention relates more especially to such sachets obtained from a unitary cut-out, preferably longiform and with two large sides parallel, the cut-out being folded on itself to define two faces of generally quadrangular shape of the sachet, the two faces being joined edge to edge by three sides and joining along a fourth side by a bottom formed by the median part of the cut-out placed in three-dimensional form.

European Patent 0162119 in particular discloses a device for shaping this cut-out, particularly for placing the bottom in three-dimensional form so that the fold of the two faces against each other, from the shaped bottom, defines a volume constituting the sachet intended to receive the unitary dose of product.

In the embodiment described in the European Patent mentioned above, the bottom is shaped by automatic means so as to cause a spacing apart of the two faces, shaping this bottom along an arcuate transverse wall, the two lateral edges separating the bottom from the corresponding face along an arc of circle, and the two arcuate edges joining on the sides of the sachet.

However, this embodiment capable of being shaped by mechanical means does not make it possible to obtain a sachet adapted to stand up by itself, resting on its bottom, since the latter is in hollowed, incurved form.

The invention, according to a first object, makes it possible to produce a sachet of the type concerned, employing mechanical means, the sachet standing up by itself and resting on its bottom like a bottle.

Another object of the invention and (sic.) to allow the production of sachets of the type specified, presenting a mechanical strength and a satisfactory homogeneity, making it possible, in particular, to withstand pressures and mechanical stresses.

Another object of the invention is to allow production of a sachet presenting highly reliable characteristics of tightness.

Finally, according to another object, the invention makes it possible to produce sachets presenting a novel configuration of improved aesthetic characteristics pleasing to the eye and easy to manipulate, adding to the convenience of use resulting from the stand-up positioning of the sachet in vertical position resting by its bottom on a support surface.

To that end, the invention firstly relates to a sachet of the type obtained from a single, plane, longiform cut-out with two long edges parallel, this cut-out being folded on itself to define the two faces of the sachet joining by a transverse bottom formed by the median part of the cut-out, the two faces of the sachet being joined edge to edge by their two long edges and the small side opposite the bottom, the sachet being characterized in that the bottom comprises two triangular facets opposite back to back from the central zone of said bottom, the two triangular facets being folded towards the inner volume of the sachet, the apex of the triangle being oriented upwardly towards the outside and joining the corresponding long edge of the sachet and each long edge of the sachet, formed by the marginal join of the two faces comprises in the zone located between said apex of the triangle and the base of the sachet, four thicknesses or layers coming from the initial cut-out, glued together and the two inner layers glued together are provided to be slightly recessed towards the inside, leaving a marginal zone coming from the two outer layers thus coming into contact with one another and glued together beyond the terminal edge of the two inner layers, thus ensuring tightness and homogeneity of the sachet.

According to a first embodiment, the sachet is provided with a bottom comprising between the two opposite lateral triangles a central rectangular facet forming the plane bottom of the sachet, two opposite sides of the rectangle separating the latter from the corresponding face of the sachet and the other two opposite sides constituting the base of one of the two lateral triangles located between the faces of the sachet and of which the apex opposite said base joins the corresponding large edge.

The invention also relates to a cut-out for forming and making a three-dimensional sachet of the type specified and adapted to contain a unitary dose of a product, the cut-out being made of supple and semi-rigid material such as cardboard, plastified cardboard, complex or the like and the cut-out is of the type of generally quadrangular shape, the two large parallel sides being adapted to come into contact with each other by folding the cut-out on itself from the median zone having to constitute the bottom so that the two parallel sides are thus connected by their edge and by their transverse side opposite the bottom, thus enclosing the inner space defining the sachet, and the cut-out comprises lines of fold pre-formed by stamping, including two parallel lines, called bottom fold lines, defining a central zone having to form the bottom and inside this central zone, lines of fold forming two triangles opposite back to back, an apex of each triangle joining the corresponding edge, and the cut-out is noteworthy in that it comprises on its two long edges a notch included between said two parallel bottom fold lines defining the bottom of the sachet, the two long edges in the notched zone being recessed towards the inside and parallel to the preceding edge.

The invention also relates to a device for shaping a cut-out intended for producing a sachet, cut-out which is preferably longiform and with two parallel edges, the cut-out being adapted to be folded on itself to define the two faces of the sachet separated by a bottom coming from the median part of the cut-out, the device allowing shaping of the cut-out in a plurality of configurations in three dimensions and being of the type comprising a punch in relief for the three-dimensional shaping of the central part of the cut-out having to form the bottom joining the two faces of the sachet and the punch cooperating with a hollow die of complementary shape, the punch and the die being displaceable in a movement of approach and moving apart towards and away from each other, imprisoning therebetween the cut-out whose bottom is thus shaped, the device being characterized in that the punch and the die are mounted to slide inside a common guiding sleeve interrupted by a transverse slot for the introduction of the cut-out to be formed, the punch on the one hand and the die on the other hand, in their rest position, being disposed on either side of said slot and the punch and the die being adapted to encounter the median part of the cut-out first, as desired, with a view to shaping the bottom by causing this median part to penetrate inside the sleeve and thus folding the two faces towards each other from the bottom, the fold being made in the direction opposite the direction of penetration, the encounter of the male punch and of the female die forming the bottom and the device thus allowing at least two forms depending on whether the faces are folded down towards each other from the bottom either on the punch side or on the die side.

Other characteristics and advantages of the invention will appear from the following description which is given in connection with a particular embodiment presented by way of non-limiting example, with reference to the accompanying drawings.

FIG. 1*a* shows a plan view of a first embodiment of a cut-out used within the scope of the invention.

FIG. 1*b* shows a view in detail of the cut-out of FIG. 1*a* and illustrating more particularly the lateral notch disposed on each of the two large edges of the cut-out.

Figure 2:
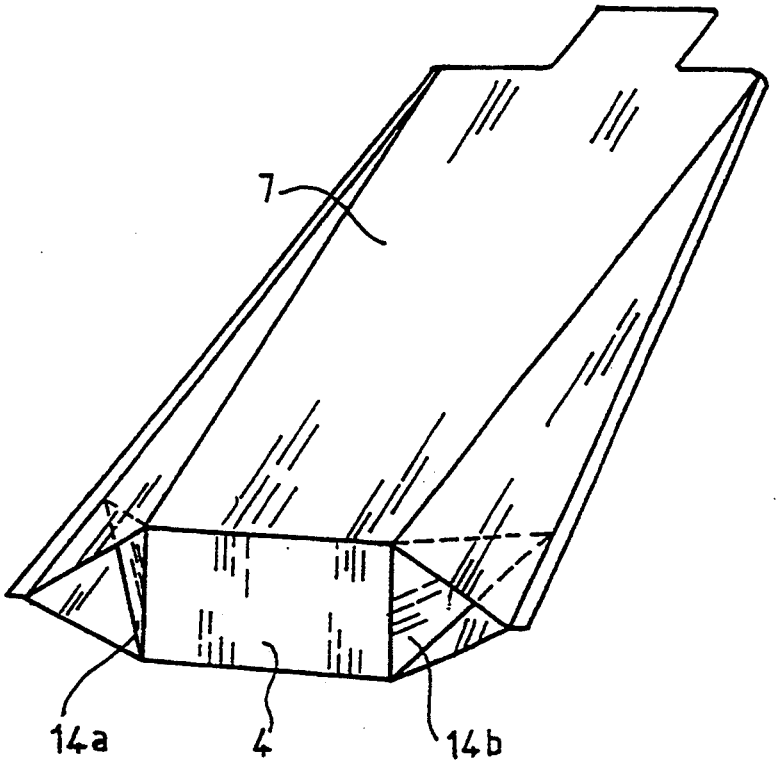
FIG. 2 shows a first embodiment of a sachet made within the scope of the invention.
Figures 3, 4, 5A, 5B:
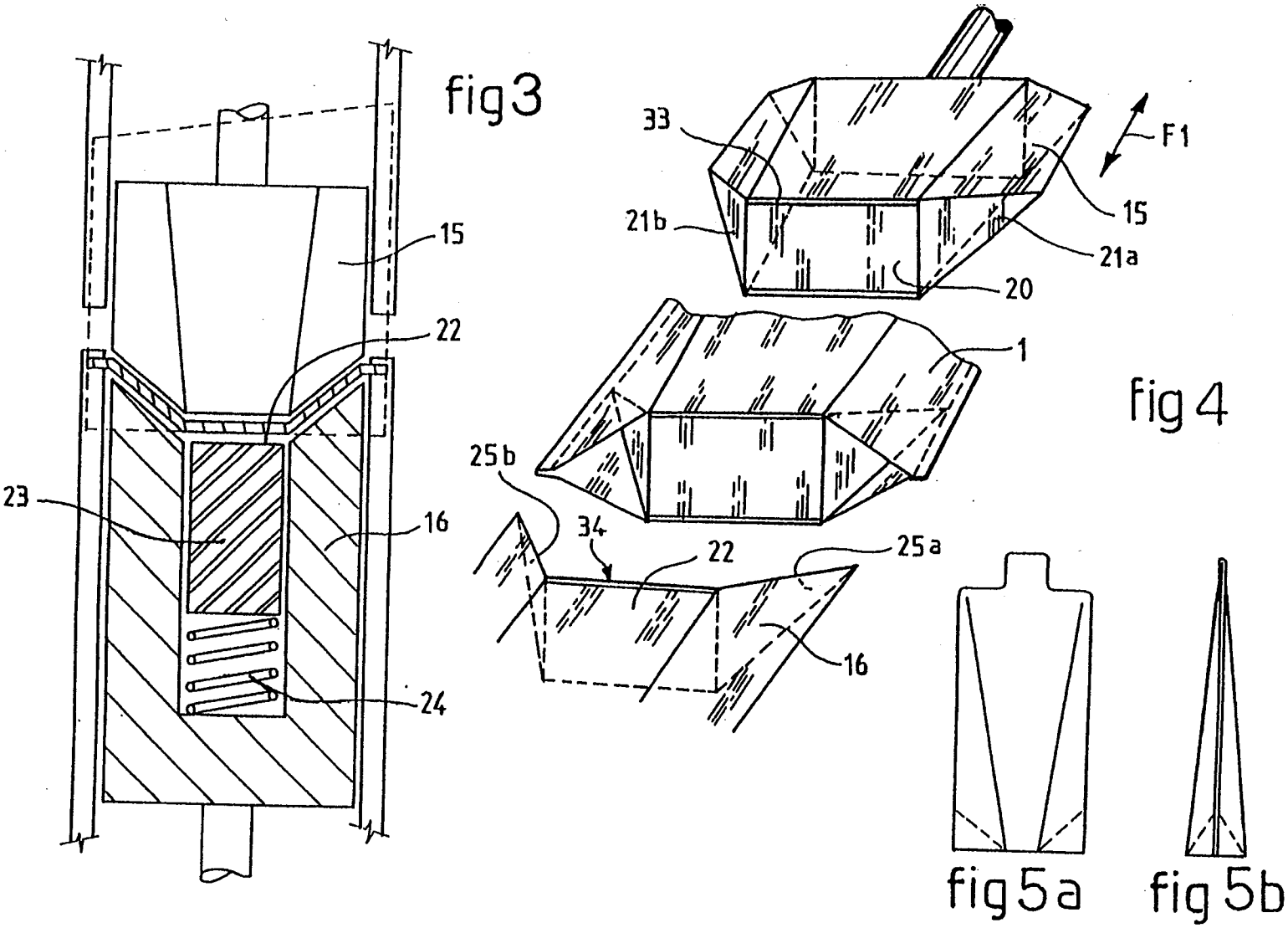
FIG. 3 shows a view in section of a punch and a die used for making the sachet of FIG. 2.
FIG. 4 shows a view in perspective of the mutual clearance of the complementary punch and die to shape the sachet of FIG. 2.

FIG. 5*a* and FIG. 5*b* show views of the sachet of FIG. 2 in stable position resting on a plane, respectively in frontal elevation (5*a*) and in side elevation (5*b*).

Figure 6A:
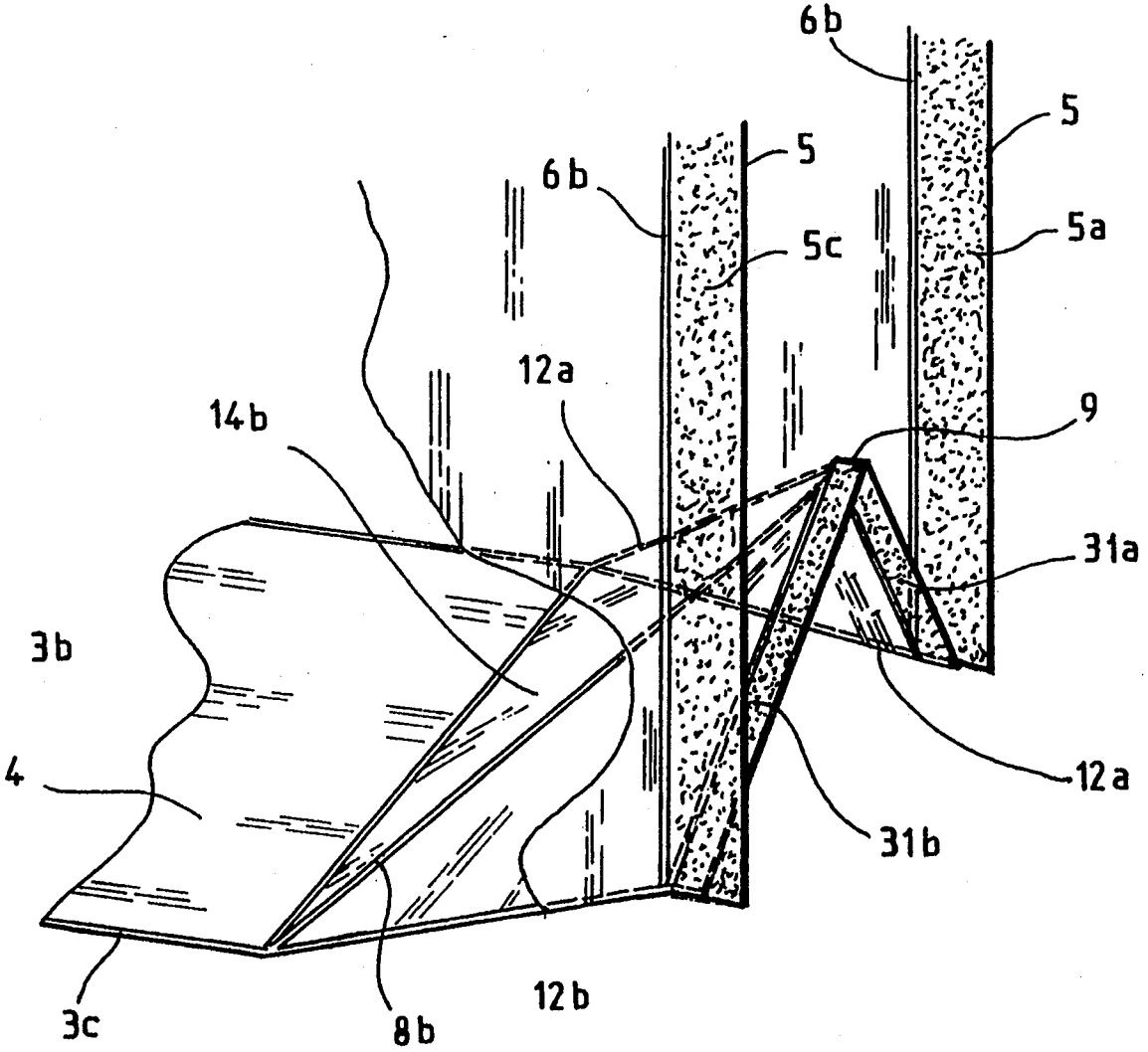
Figure 6B:
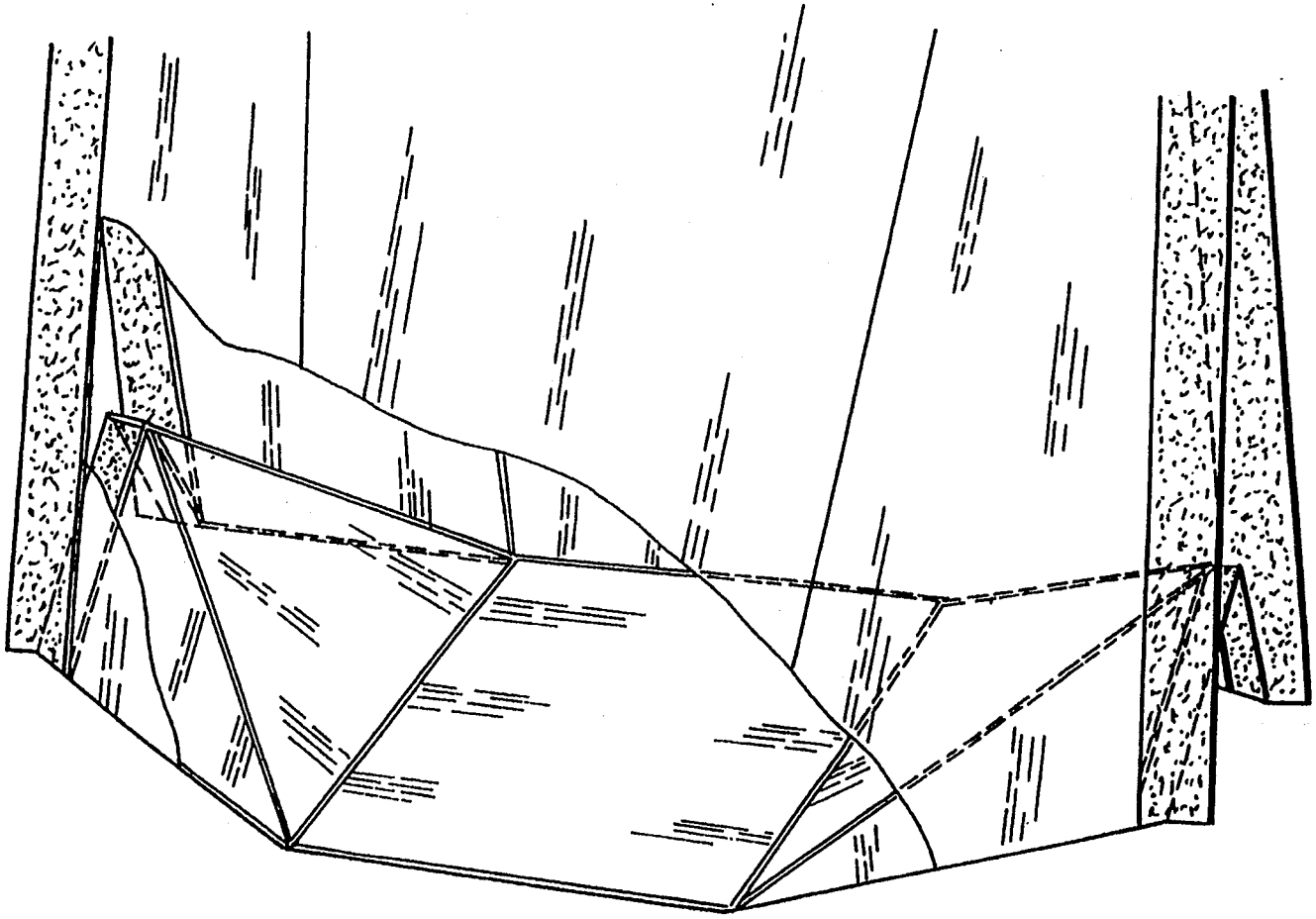

FIGS. 6*a* and 6*b* show views in perspective, in greater detail and enlarged in FIG. 6*a*, of the assembly of the lateral edges in the course of approach in order to be joined during shaping of the sachet.

Figure 7:
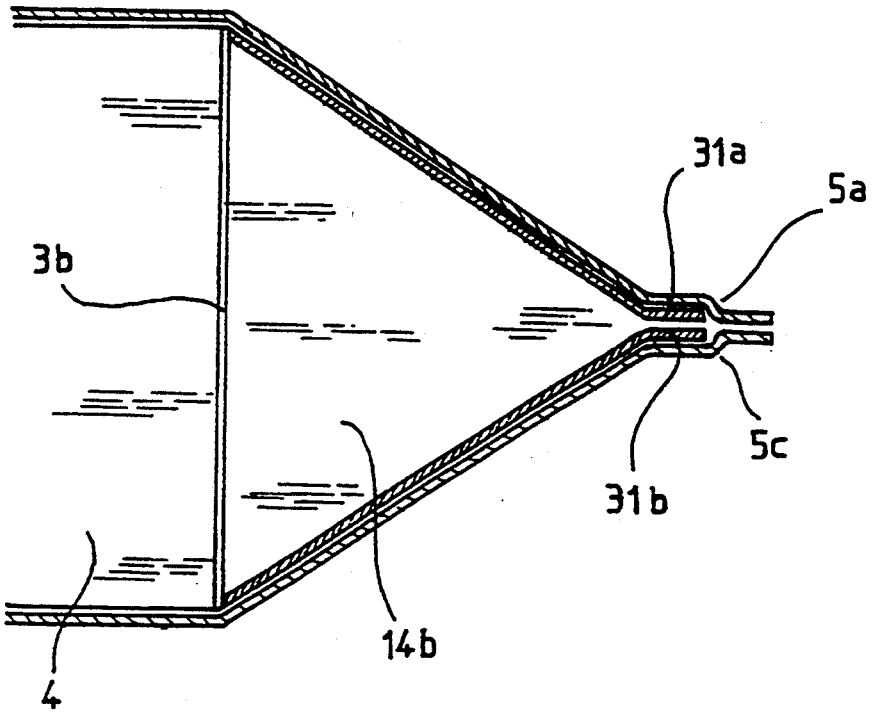

FIG. 7 shows a view in section of the form of the sachet at the level of the apex of the lateral triangle constituting a lateral facet of the bottom.

Figure 8:
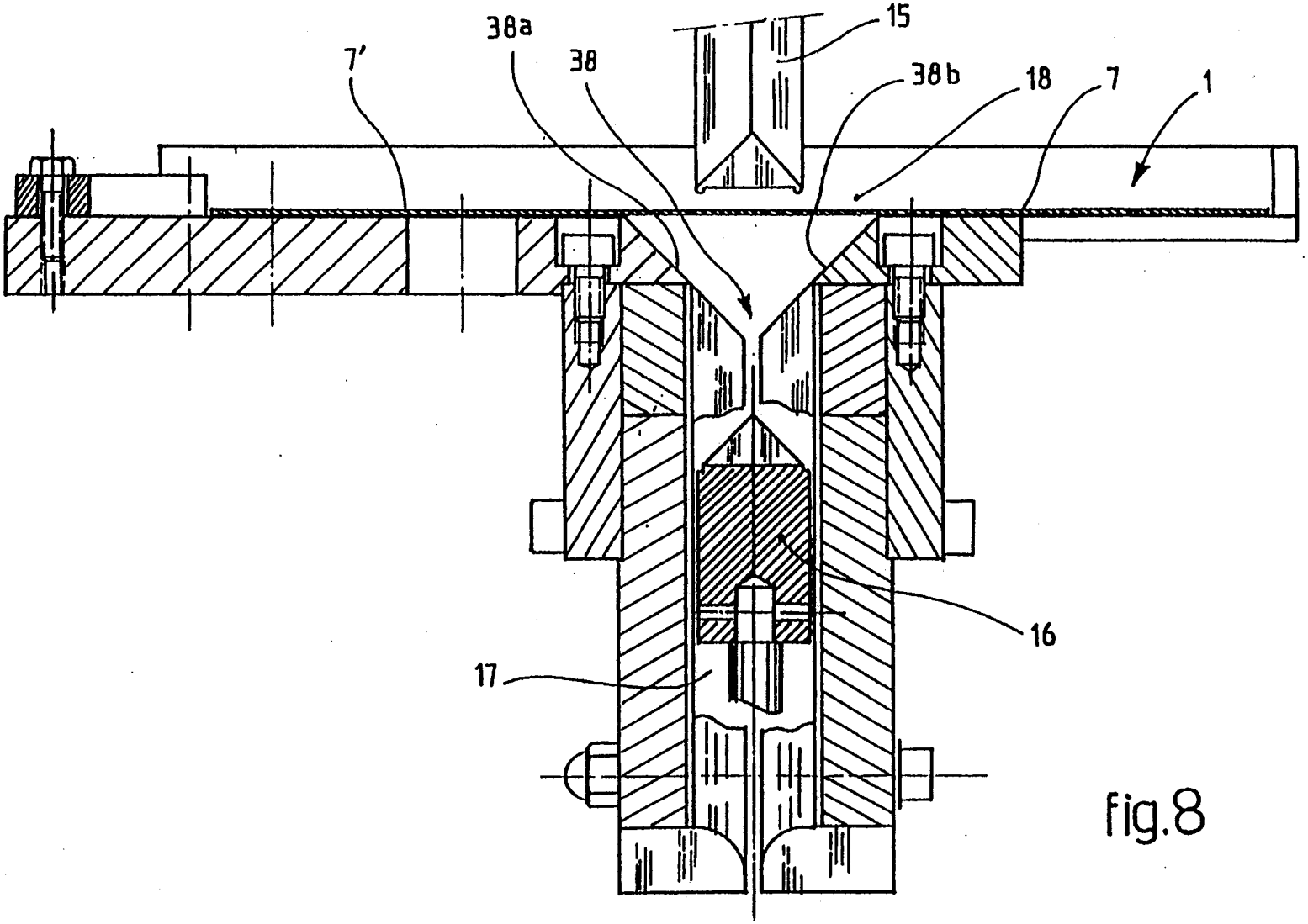

FIG. 8 shows a view in section of a shaping machine comprising complementary punch and die for forming a sachet according to FIGS. 2, 4, 5*a*, 5*b*.

Figure 10:
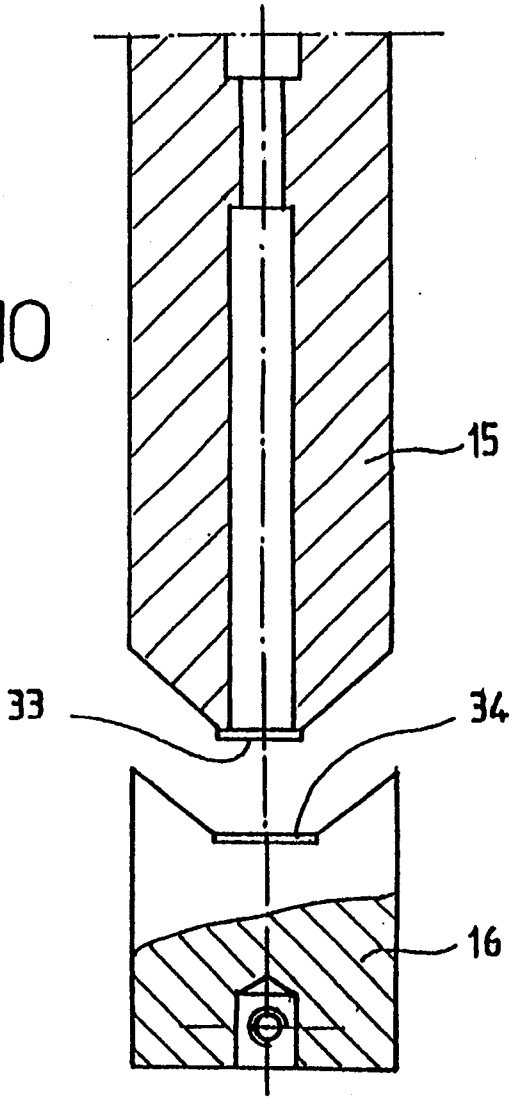
Figure 9:
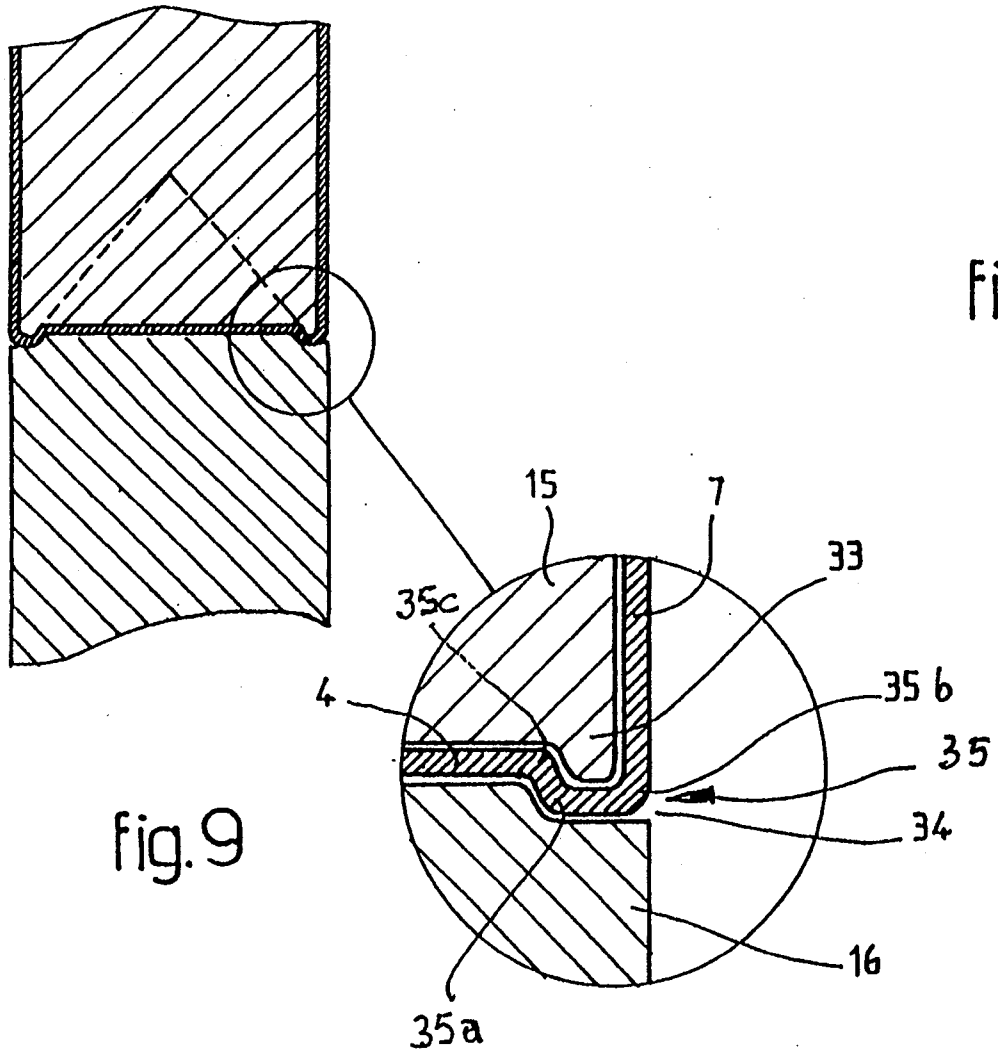

FIGS. 9 and 10 show views of the engagement of a groove integral with the punch cooperating with a groove disposed on the die to form an open tubular structure constituting a stiffener on the bottom of the sachet.

Figure 11:
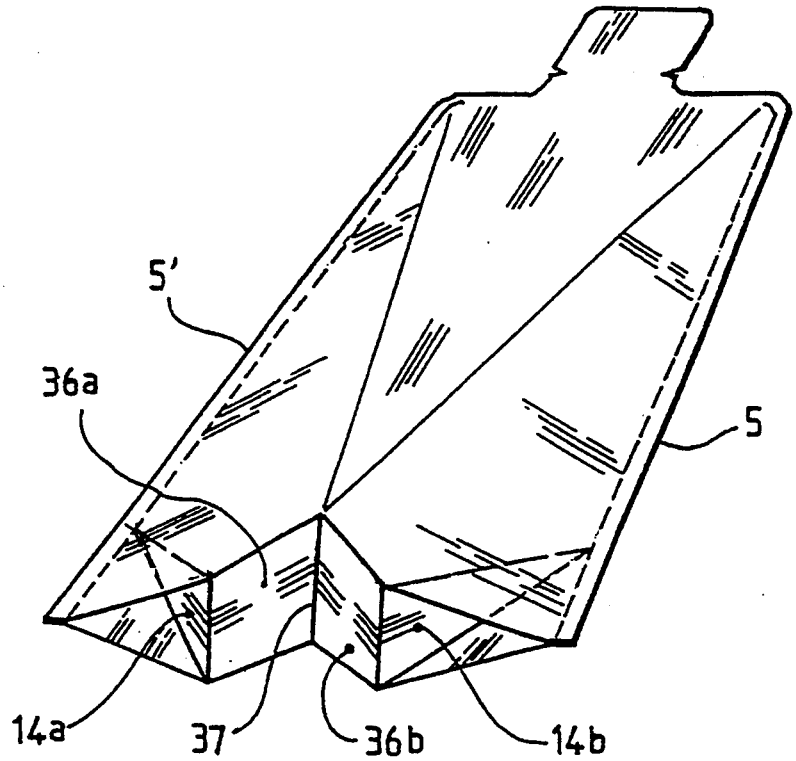
Figure 12:
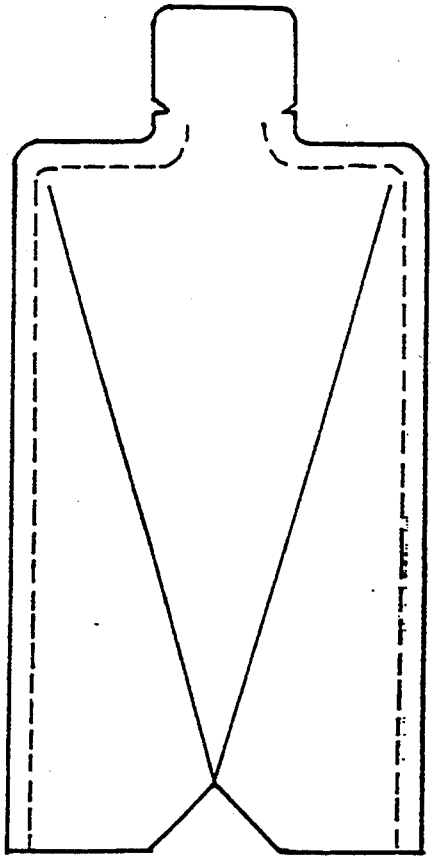

FIGS. 11 and 12 show a variant embodiment of the sachet according to the invention respectively in perspective (FIG. 11) and in vertical stand-up position in frontal elevation (FIG. 12).

FIG. 13 shows a view in section of a punch and a die intended to form the sachet of FIGS. 11 and 12, Whilst FIG. 14 shows the complementary clearance of the punch and of the die in the course of operation.

Figure 15:
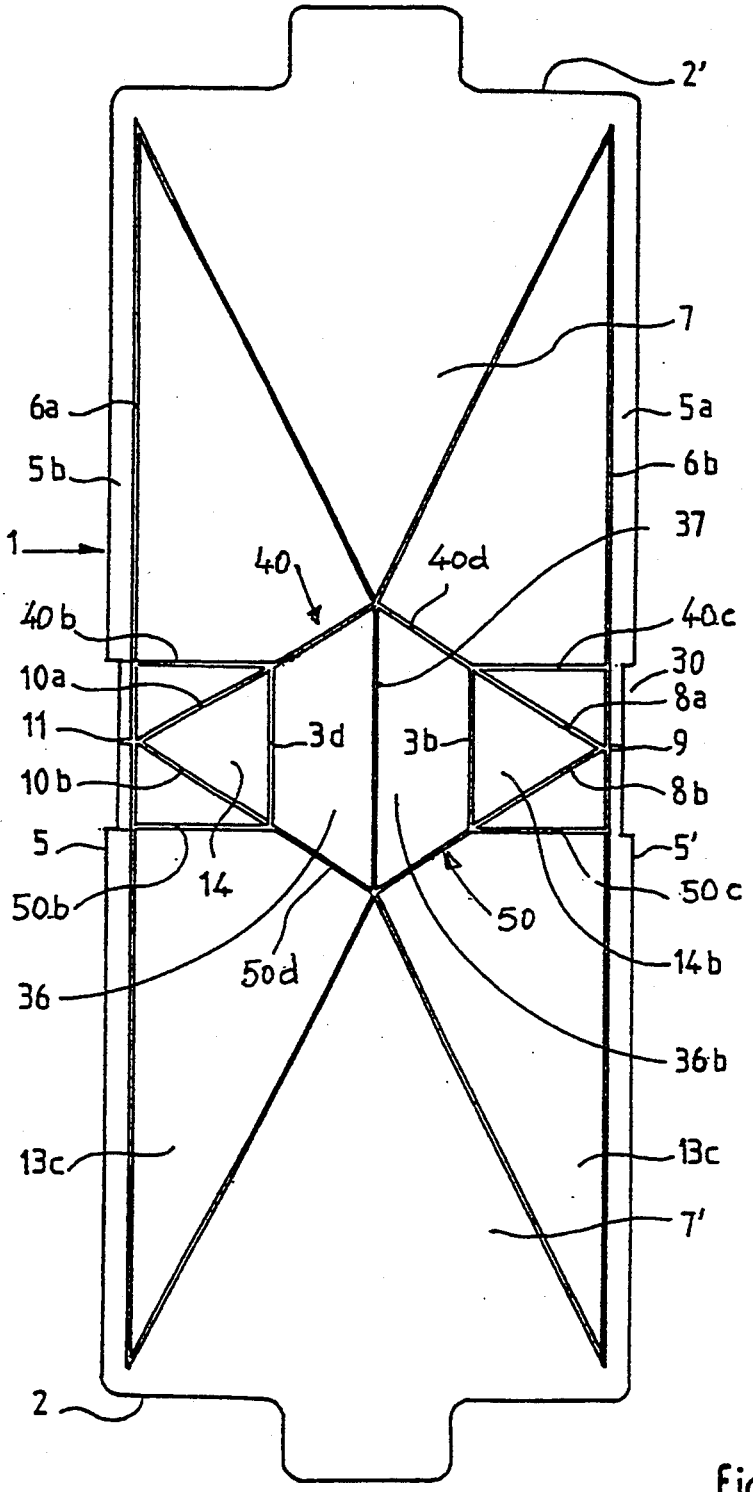

FIG. 15 shows a plan view of a cut-out used to form a sachet according to FIGS. 12 and 13.

Figure 16:
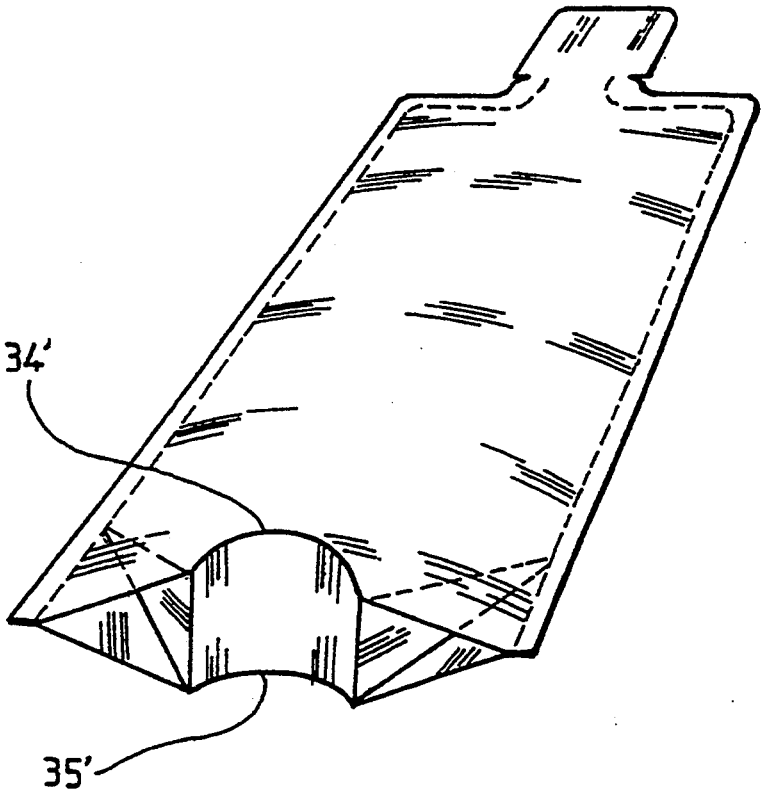
Figure 17:
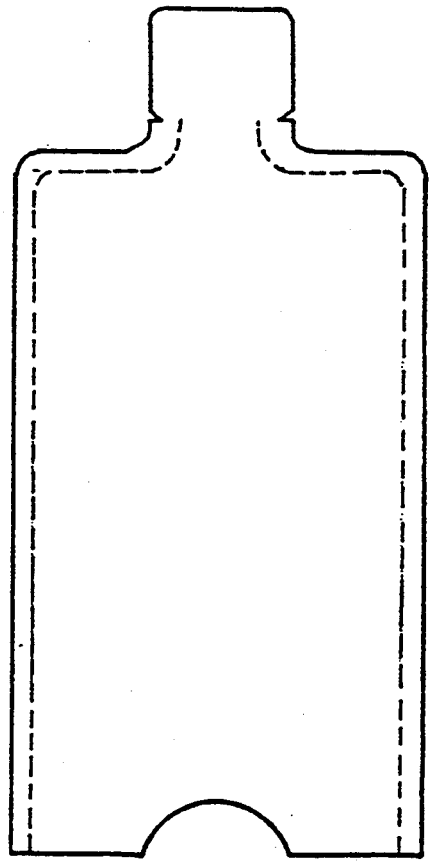

FIG. 16 shows a view in perspective of a variant embodiment of a sachet according to the invention, of which FIG. 17 shows a view in frontal elevation in vertical stand-up position.

Figure 18:
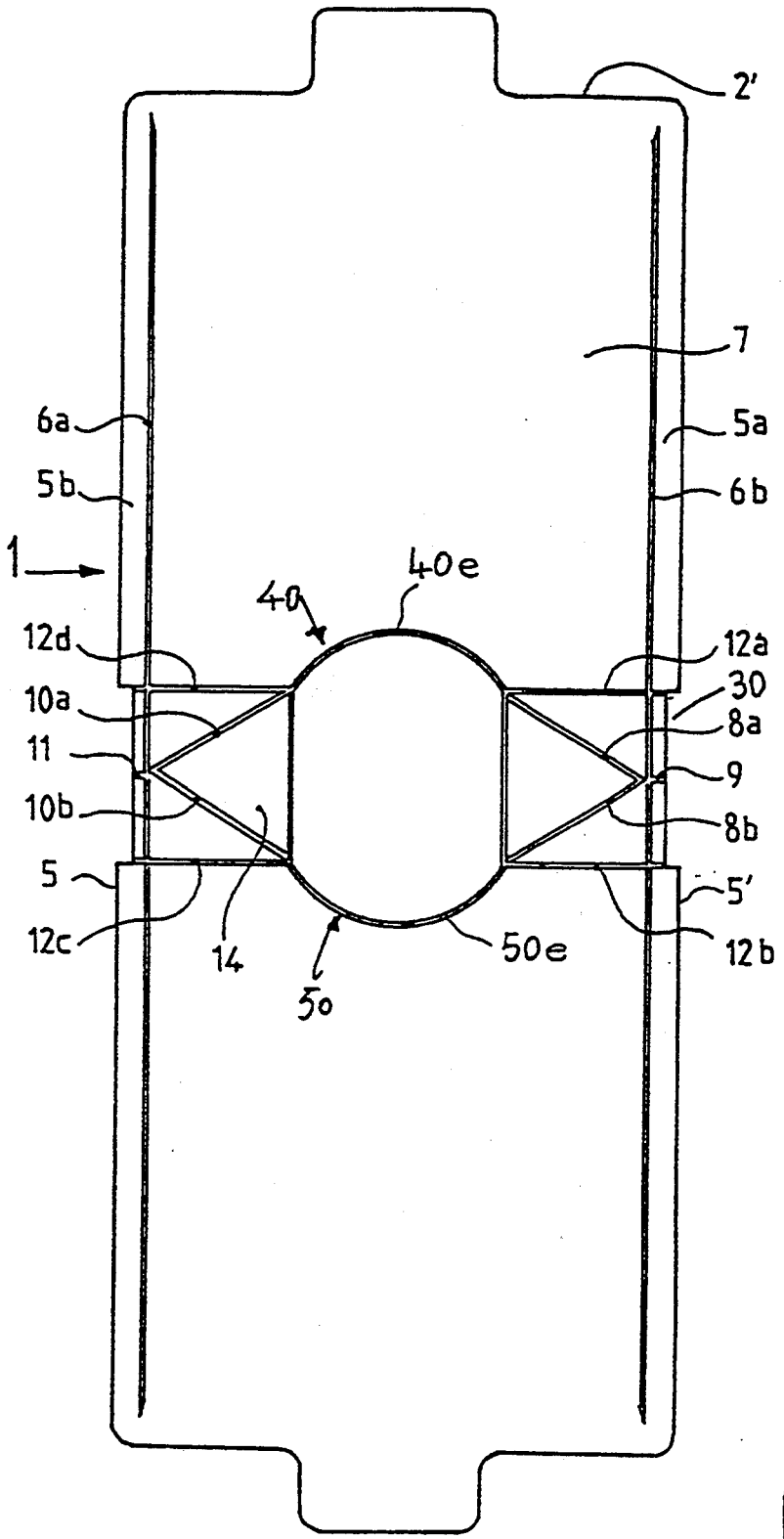

FIG. 18 shows a plan view of a cut-out which may be used for making the sachet of FIGS. 16 and 17.

Figure 20:
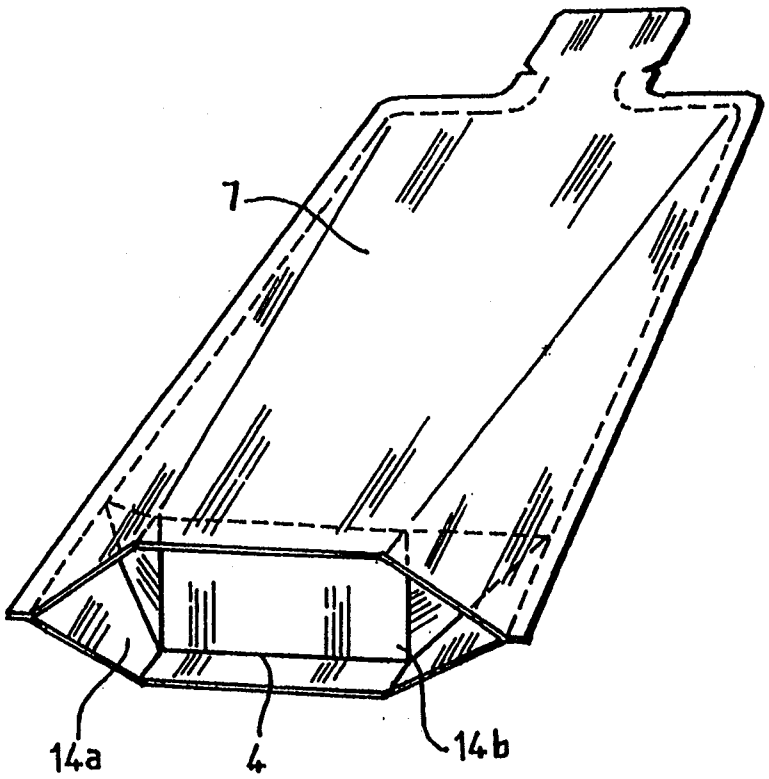
Figure 19:
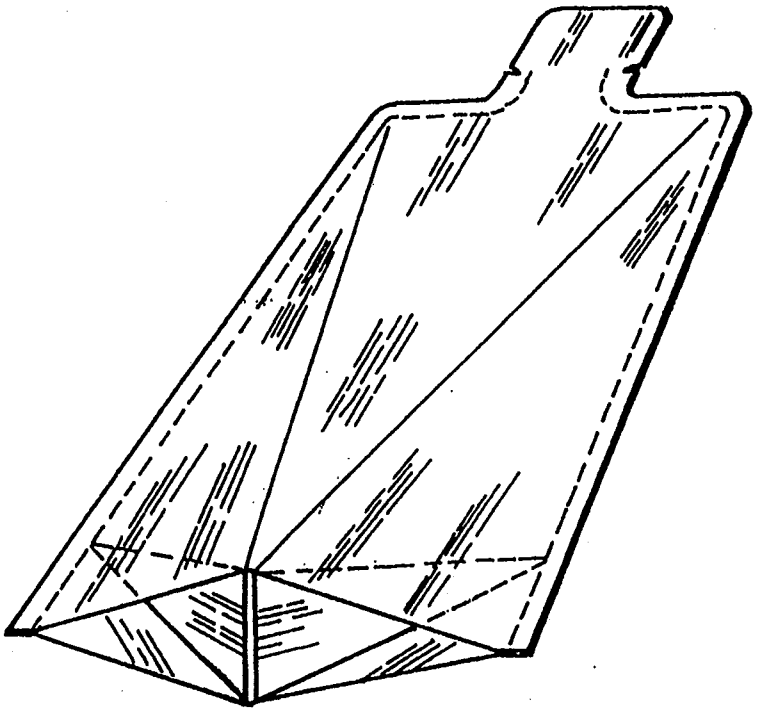

FIGS. 19 and 20 show two variant embodiments of the invention within the framework of forming sachets of different structure.

On firstly considering FIG. 1, it is seen that a blank or cut-out 1 of generally quadrangular, oblong shape is made, comprising on the two small sides 2 and 2' a tongue or protuberance which will form that part of the sachet to be cut for opening thereof.

The cut-out comprises a large number of lines of fold which are obtained by embossing respectively in recess and in relief so as to constitute zones of weakening of the material constituted for example by cardboard, bristol board or complex of synthetic material; advantageously, a complex based on water-proofed cardboard will be used on the face which will correspond to the inner wall of the sachet once formed, and in particular by a coating of polyethylene ensuring connection of the edges of the sachet by heat-welding.

In this way, there are disposed on this cut-out 1 the four lines 40*a*, 50*d*, 3*c*, 3*d* which define a central rectangle 4 located at equal distance respectively from the large sides 5, 5' and the small sides 2 and 2' of the cut-out 1.

Optionally and according to a variant, the rectangle 4 may be reduced to a narrow band, the two sides 3*a* and 3*c* being very close, the rectangle 4 may be reduced to a simple line 3*e*, the two lines of fold 3*a* and 3*c* in that case being merged, which results in the embodiment shown in FIG. 19 deriving directly from the same conception.

Parallel to the large sides 5 and 5' run the lines of fold 6*a* and 6*b* which define the marginal zones 5*a* and 5*b* serving, during production of the sachet, for gluing (particularly for thermo-adhesion) of the edge 5 and 5' during final forming of the sachet by folding the two halves 7 and 7' respectively located on each side of the bottom.

The bottom is defined by the median zone defined by the two parallel lines of fold or bottom line 40 and 50 respectively, formed by segments 40*a* and 50*d* colinear with their extension 40*b*, 40*c* and 50*b*, 50*c*, thus defining the two parallel lines 40, 50 between which foldable facets will form the bottom as described hereinafter.

The bottom facets are defined by lines of fold on one side 8*a* and 8*b* which converge towards edge 5', joining at the level of the marginal line of fold 6*b* to merge in the single line of fold 9.

Symmetrically and on the opposite side of the central rectangle are found the lines of Gold 10*a* and 10*b* converging towards the edge 5, these two lines of fold joining to form the line of fold 11, symmetrical to line 9; the two lines 9 and 11 being located substantially in the middle of the large sides 5 and 5' of the cut-out.

The lines of fold 40*d* and 50*d* which form two opposite sides of the rectangle 4 are extended by the lines of fold 40*b*, 40*c*, 50*b* respectively which join the marginal lines 6*a* and 6*b* and extend up to edges 5 and 5'.

Finally, from each of the angles of the rectangle 4 issue diagonal lines of fold 13*a*, 13*b*, 13*c* and 13*d* respectively which extend to the corresponding angles of the cut-out 1, joining the marginal lines of fold 6*a* and 6*b*.

FIGS. 2, 3, 4, 5*a*, 5*b* show that the cut-out of FIG. 1 may, by folding the two faces 7 and 7' towards each other, from the bottom itself formed by the median part of the cut-out, obtain a sachet whose shape is capable of taking the configurations on the one hand shown in perspective in FIG. 2.

In order to ensure the shaping of the bottom and the folding of the two faces against each other, mechanically, to the desired configuration, a device is used within the framework of the invention, shown schematically in FIGS. 3, 4 and 8 and constituted by a punch 15 in relief cooperating with a recessed die 16.

The punch and the die are mounted to slide inside a guiding assembly formed by a common sleeve 17 in which the punch and the die may encounter each other.

The guiding device or sleeve 17 is interrupted transversely by the slot 18 allowing the introduction of the cut-out 1 intended to be shaped by the clearance of the respective displacement of the punch and of the die.

The shaping of the sachet may thus be effected mechanically before it is filled, the cut-out 1 being supplied from a lateral magazine containing a reserve of cut-outs.

The punch is shown in greater detail and in perspective in FIG. 4. It is seen that it comprises three facets, viz. a quadrangular central facet 20 which corresponds in shape and in dimensions to the quadrangular central facet 4 of the cut-out, and may therefore be reduced to a simple edge (FIG. 19).

The two triangular lateral facets 21*a* and 21*b* correspond to the respective facets 14*a* and 14*b* of the cut-out. To that end, the two facets 21*a* and 21*b* have the configuration of an equilateral triangle; they are disposed in symmetrical planes each located substantially at 45° with respect to the transverse plane of the facet 20 itself perpendicular with respect to the movement of displacement of the punch symbolized by arrow F1.

As for the die 16, it presents a hollow recess which is substantially complementary of the impression in relief formed by the head of the punch 15.

In this hollow impression of the die 16 there is found a central face constituted by the transverse face 22 of the head of the piston 23 mounted to slide inside the die 16 and returned into projecting position by the return spring 24.

On each side of the quadrangular central face of the die 22 are located facets 25*a*, 25*b* each formed by an equilateral triangle and disposed substantially at 45° with respect to the plane of the principal transverse facet 22.

It is thus seen that punch 15 may come into contact with the receiver die 16, the two impressions being of complementary relief and dimensions coming into mutual fit with each other, face 20 of the punch repelling face 22 of the plunger piston 23, the facets a and 21*b* then being applied against facets 25*a* and 25*b* of the die.

It is seen that, in this movement, the cut-out 1 may therefore be shaped, being imprisoned between the two complementary elements, namely the punch on the one hand and the receiver die on the other hand.

According to a development of the invention which is shown in particular in detail in FIGS. 1*a* and 1*b*, the edges 5, 5' corresponding to the two large edges of the cut-out are provided with notches 30, 30' in the median part of said large edges which corresponds to the conformation of the bottom and which is defined by the two parallel, so-called bottom fold lines 3*a* and 3*b* respectively and their extension towards the edge 40*b*, 40*c* respectively on one side and 50*b*, 50*c* on the other.

This notch 30 is defined between the two shoulders 30*a*, 30*b* on the edge 5' and its bottom 30*c* runs parallel to edge 5' and slightly recessed with respect to this edge.

Edge 30*c* defining the bottom of the notch is preferably located substantially in the middle of the marginal zone 5*a*, 5*c* which separates the edge 5' from the marginal line of fold 6*b*, with the result that the distance 1 (FIG. 1*b*) which separates the edge 30*c* forming the bottom of the notch of the marginal line of fold 13*b* is substantially half the width L which separates the edge 5 from the marginal line of fold in the un-notched part of said large edges.

The advantage of this notch is, as will be seen hereinafter, that of ensuring tightness and homogeneity in the structure of the sachet after conformation.

FIG. 1*b*, as well as FIGS. 6*a* and 6*b* represent the marginal parts 5*a*, 5*b* of the edges 5 with broken lines to show the zones in which the edges are glued to shape the sachet.

In fact, it has been provided that the sachet comprises at least on its faces coming opposite, with a view to thermo-seal thereof, a coating, particularly of polyethylene capable of ensuring not only tightness of the sachet but also thermo-seal of the edges when the sachet is being formed.

And such thermo-seal, obtained by pressure of the two edges of the two faces 7 and 7' against each other by heating jaws, ensures connection of the assembly.

The notches 30 disposed on each side of the large edges of the cut-out will ensure an efficient connection of these edges 5, 5'.

In fact, it is seen, particularly in the light of FIGS. 6*a*, 6*b* and 7, that, when the two edges 5*a* and 5*c* approach each other to come into contact, accompanied by the formation of internal bellows by rise of the triangle 14*b*, the marginal parts 31*a* and 31*b* which belong to the median part of the bottom in the course of being folded, are inserted between the edges 5*a*, 5*c* having to be glued.

In the absence of notches, the opposite thermo-sealable face 31*a* will adhere to band 5*a*, whilst the face of band 31*b* will adhere to band 5*c*.

If it is desired to obtain that the inner faces of the bands 31*a* and 31*b* in contact also be thermo-sealed, it is then necessary to deposit a layer of polyethylene not only on that face of the cut-out which will form the interior of the sachet, but also on that face which constitutes the exterior, hence a technological handicap necessitating an operation or the choice of a more expensive complex and possibly problems at the level of decoration of the sachet.

Without this thermo-sealable coating on that face which constitutes the back of the cut-out, it is seen that, between the line of fold 9 and the base of the sachet, the two sides 5*a* and 5*b* will necessarily gape, consequently initiating a line of separation detrimental to the tightness and to the mechanical strength of the sachet.

Within the scope of the invention, the notch 30 makes it possible, after fold of the two bands 31*a* and 31*b* against each other, to leave a projecting marginal part of the zones 5*a* and 5*c* which may thus come into contact with each other and be thermo-sealed, consequently ensuring perfect finishing, tightness and mechanical strength of the base of the sachet.

FIG. 7 shows in particular the projecting part of the lateral bands 5*a* and 5*c* which join beyond the terminal edge of the inner bands 31*a*, 31*b*.

And FIG. 6*b* shows that this same device is found on both sides of the sachet, thus ensuring on both sides and symmetrically, a perfect closure of the two faces against each other, particularly at the level of their longitudinal edges.

Which, in addition to the tightness and mechanical strength of the sachet, ensures a satisfactory aesthetic appearance, avoiding the sight of the gaping presented by the two non-contiguous edges.

FIG. 9 and FIG. 10 show a development of the invention, according to which the pre-formed lines of fold 3*a* and 3*b* respectively which define the sides of the rectangle forming the bottom joining the corresponding faces 7 and 7', receive, during shaping of the sachet, an additional stamping forming a fold of the cut-out on itself.

To that end and according to FIGS. 4 and 9, it is seen that two parallel edges disposed on the punch 15 comprise a groove 33 in relief, cooperating with the recessed groove 34 made in the die 16.

The cut-out 1 is thus stamped between the male groove 33 and the female groove 34 to form an open tubular structure forming stiffener 35 and ensuring clean cut of the bottom and the stability of the separation edge between the rectangular bottom 4 and the corresponding face 7. The stiffener 35 is constituted by the shoulder 35*c* downwardly, followed by the two re-entrant angles 35*d* and 35*b* then joining face 7.

FIGS. 11, 12, 13 and 14 show a variant embodiment derived from the preceding embodiment and in which the central rectangle 4 is replaced by an inward stand-back of the sachet obtained by appropriate shaping of the lines of fold 40, 50 comprising at their centre an angular line of fold 49*d*, 50*d*.

These lines of angular fold respectively extending the lines of fold 10*a*, 10*b*, on the one hand, 8*a*, 8*b* on the other hand, to form a diamond together.

In this conformation are found the two lateral triangles 14*a*, 14*b*; the intermediate zone of the bottom located between the two triangles is itself formed by two trapezoidal facets 36*a*, 36*b*, the two trapezia being opposite by their large base 37 which forms the recessed edge defining the bottom of the stand-back towards the interior of the central zone.

FIGS. 13 and 14 show that the punches and dies are shaped in appropriate manner, creating from the cut-out of FIG. 15 the conditions of shaping resulting in the representation in relief of FIG. 11.

In this way, a sachet is obtained, with a shape pleasant to the eye and whose recessed base procures a renewed aesthetic effect.

A sachet is especially obtained, presenting an improved stability insofar as the sachet rests on the two lines of support 3*b*, 3*d* completed by the triangular bottom joining the two opposite edges 5, 5'. The stability of the sachet on a rest plane is improved insofar as it may be adapted to a plane comprising unequal relief which will be absorbed in the hollow zones constituting the recessed bottom.

A variant of the sachet of FIGS. 11, 12 and shown in FIGS. 16 and 17 being obtained from the cut-out of FIG. 18.

The embodiment is substantially similar to the configuration of FIGS. 11 and 12, the angular offset of the bottom lines 40*d*, 50*d* here being replaced by incurved lines 40*e*, 50*e*, respectively.

Finally, FIG. 19 shows a variant embodiment in which the central rectangle is replaced by a simple line 3*e*, the two sides merging and the two lateral triangles being opposite by the common transverse edge.

In FIG. 20, the variant includes the configuration of FIGS. 2 et seq. in which the central rectangle 41 constituting the bottom is offset towards the interior of the sachet by a fold on itself of the base constituting the base of the faces 7 and 7' which, due to this fold at the base of the inner part of the bottom, forms a stiffening rib which constitutes a continuous belt following the periphery of the base of the sachet, the latter resting on this belt folded on itself, the bottom thus being offset away from any contact with the support plane.

In all the cases which have been shown here, the shaping of the sachet is obtained under identical conditions from a shaping assembly as shown in FIG. 8; the two faces 7 and 7' of the cut-out are brought towards each other by the slot 38 whose edges 38*a* and 38*b* perform the role of cam; the penetration of the punch 15 downwardly inside the sleeve 17 brings the two faces 7 and 7' of the cut-out against each other.

According to one embodiment, the quality of the adherence between the two edges with marginal bands 5*a* and 5*c* on the one hand, 5*b* and 5*d* on the other hand, may be adjusted so as to allow a sufficient resistance for the conservation of the product contained, the adherence not, however, withstanding a traction exerted on the two faces 7 and 7' from the upper tongues 2*a*, 2*b*, which allows easy separation of the two faces to obtain a peel-open sachet thus releasing the solid product contained.

It is seen that the invention will be applicable to numerous forms of embodiment.

The invention makes it possible, in particular, to produce sachets intended to contain unitary doses of liquid, pasty, pulverulent products.

In particular, it will be used for containing samples distributed free for advertizing purposes or quantities corresponding to a single use or to a plurality of successive uses; the configuration of the sachet, the two convex faces 7 and 7' being automatically brought against each other at their summit, thus closing the lips of the opening obtained after cutting the projecting lugs or tongues 2*a*, 2*b*.

The projecting tongues may advantageously be replaced by a dispensing device with obturation (stopper or pouring spout) of known type.

Within the framework of the invention, a real flask is thus produced, capable of containing products of current use, such as cleaning products, detergents, washing products, shampoos, creams, cosmetics or technical products such as adhesives, lubricants, manufacturing additives, and this in a particularly economical packing which is advantageous in its mode of use; the pressure exerted on the lateral facets 7 and 7' enables an exact dose of the product to be pressed out through its dispensing orifice; the latter closing as set forth hereinabove after the end of the pressure exerted on the lateral faces 7 and 7'.

The flask may be made of material such as cardboard plasticized on one, inner, face, thus ensuring biodegradability thereof and avoiding pollution of the environment for many years when it has been used.

The expression "sachet" has been used all along the description to designate the object made according to the invention or, accessorily and is hereinabove, the word "flask".

It must be understood that the word "sachet" does not limit the scope of the invention and the latter may be used for any container independently of the product contained, of the material constituting the walls of the container, of the shape of the walls or the contour. In particular, the upper part, i.e. the shoulders and upper tongues may present configurations evoking for example the form of a stopper or bottle neck corresponding to more conventional containers, and this in order to enhance and render more pleasant the presentation of the product.

The product contained may advantageously be produced, sold for its market value and not solely a sample or a product intended for a single use; the sachet may in fact contain a reserve corresponding to successive uses.

In the case of food products, particularly in powder form, the product may incorporate additives in the form of "witnesses", for example additives in the form of dehydrated plants (spices, aromatic plants, etc . . . ).

Finally, the sachet may be presented in the form of two twinned sachets comprising a common tongue for opening, thus allowing the extemporaneous mixture of two products adapted to be conserved separately.

We claim:

1. A stand-up sachet comprising:

a pair of opposing face walls each comprising a top edge, a bottom edge having a pair of outer edge portions and a central edge portion therebetween, two parallel outer side edges, and primary marginal side regions formed along said outer side edges, said primary marginal side regions having a first width;

a bottom connecting said central edge portions of said bottom edges of said face walls and comprising a pair of parallel bottom support edges extending transverse to said central edge portions of said bottom edges, said bottom support edges and said central edge portions defining a central bottom wall therebetween, said bottom support edges defining a base plane coextensive with said bottom support edges, said central bottom wall being disposed above said base plane and directed inwardly towards said interior volume of said sachet, said bottom support edges being constructed and arranged to allow said sachet to balance thereon when said sachet is in its stand-up position, and said opposing face walls being sealed along said corresponding primary marginal side regions and said top edges such that said face walls and said bottom define an interior volume of said sachet, said bottom further comprising a pair of triangular facets depending from each of said bottom support edges and having side edges tapering to an apex, said triangular facets being inclined upward toward said top edges and toward said interior volume of said sachet, a pair of secondary marginal side regions corresponding to said primary marginal side regions, said apexes of said pair of triangular facets being located at said secondary marginal side regions, and two pairs of opposing intermediate facets, each said intermediate facet of said pair depending from one of said outer edge portions of said bottom edge of said face walls and one of said tapering side edges of one of said triangular facets, each said pair of intermediate facets tapering to one of said secondary marginal side regions, each of said secondary marginal side regions having an outer side edge coextensive with a respective one of said outer side edges of said opposing face wall and a second width less than said first width of said primary marginal side regions, such that said secondary marginal regions are captured within said primary marginal side regions when said sachet is sealed in its closed position and said outer side edges of each said pair of intermediate facets are recessed from said outside edges of said opposing face walls to insure tightness and homogeneity of said sachet.

2. A stand-up sachet as claimed in claim 1, wherein said central bottom wall comprises first and second planar bottom portions each depending from said bottom support edges and being inwardly directed towards one another and connecting at a central fold line.

3. A stand-up sachet as claimed in claim 1, wherein said central bottom wall is semi-cylindrical in shape.

4. A stand-up sachet as claimed in claim 2 or 3, wherein said central edge portions of said bottom edge of said opposing face walls are each formed with an outwardly projecting tubular shoulder rib along the length thereof to stiffen said sachet and provide increased stability when said sachet is in its stand-up position.

5. A stand-up sachet as claimed in claim 1, wherein said top edges of said face walls are provided with opposing integral tab portions readily separable from one another, and said primary marginal side regions of each said face wall are adhered together with a predetermined amount of adherence to allow manual separation of said opposing face walls by moving apart said tab portions to facilitate separation of said opposing face walls and allow access to said interior volume of said sachet.

6. A device for setting up and shaping a cutout blank being adapted to be folded on itself to form a stand-up sachet according to claims 1, said device comprising:

a punch comprising a central bottom facet corresponding to said central bottom wall of said sachet, and a pair of triangular lateral facets corresponding to each of said triangular facets of said sachet, and a recessed die having a shape complimentary to the shape of said punch, said punch and die being disposed within a guide sleeve including a transverse slot for the introduction of said cutout blank, said punch and die being displaceable with respect to one another along an axial direction to set up said cutout blank by movement of said punch toward said die to shape and form said stand-up sachet.

7. A device as claimed in claim 6, wherein said central bottom facet comprises first and second surfaces inwardly directed towards one another.

8. A device as claimed in claim 6, wherein said central bottom facet is semi-cylindrical in shape.

9. A device as claimed in claim 6, wherein said central bottom facet comprises a top surface of a plunger piston moveable along said axial direction within said guide sleeve from a lower position wherein said top surface of said plunger piston is positioned such that said dye has a shape complimentary to said punch, to an upper position wherein said top surface of said plunger piston is displaced from said lower position in an upward direction toward said punch, said device further including return means for automatically returning said piston from said lower position to said upper position.

10. A device as claimed in claim 6, wherein said punch comprises two opposing bottom ridges corresponding to central edge portions of said bottom edge, said bottom ridges comprising a ribbed portion cooperating with corresponding grooves provided in said die to thereby form tubular ribs along said central edge portions of said bottom edges of said sachet to stiffen said sachet and provide increased stability thereto when said sachet is in its stand-up position.

11. A cutout blank for forming a stand-up sachet comprising:

a generally rectangular sheet of semi-rigid material having a pair of substantially parallel bottom fold lines extending in a first direction and partitioning said sheet into two face regions and a bottom region disposed between said face regions, each of said bottom fold lines having a pair of outer fold line portions and a central fold line portion therebetween, said face regions opposing one another when said blank is set up, each of said face regions being bounded by a top edge, one of said bottom fold lines, two parallel outer side edges, and primary marginal side regions formed along said outer side edges, said primary marginal side regions having a first width, said bottom region connecting said bottom fold lines and comprising two outer side edges and secondary marginal side regions corresponding to said primary marginal side regions and having a second width less than said first width of said primary marginal side regions, a central region bounded by said central fold line portions and a pair of parallel support fold lines disposed inwardly from said secondary marginal side regions and extending transverse to said central fold line portions, said support fold lines forming a pair of support edges to allow said sachet to balance thereon when said sachet is set up in its stand-up position, said central region being constructed and arranged to project inwardly towards the interior of said sachet when said sachet is set up in its stand-up position, a pair of triangular facet regions bounded by one of said support fold lines and a pair of angular fold lines extending from corners of said central region defined by the intersection of said bottom fold lines and said support fold lines and tapering to a central portion of one of said secondary marginal side regions, and two pairs of intermediate facets, each of said intermediate facets being bounded by one of said outer fold line portions of one of said bottom fold lines, one of said angular fold lines, and a portion of one of said outer side edges of said bottom region.

12. A cutout blank as claimed in claim 11, wherein said central fold line portions each include a pair of fold segments tapering towards said top edges of said face regions and towards one another and connecting at an apex, each said apex being connected to one another by a central fold line, such that said central region forms an inwardly projecting bottom wall having a triangular shape when said sachet is set up in its stand-up position.

13. A cutout blank as claimed in claim 11, wherein said central fold line portions each include an arched fold line portion connecting said support fold lines and arched inwardly towards said top edges of said face regions such that said central region forms a semi-cylindrical arched bottom wall when said sachet is set-up in its stand-up position.

14. A cutout blank as claimed in claim 11, wherein each of said outer side edges of said secondary marginal side regions is recessed between 1 to 5 mm inwardly with respect to said outer side edge of each of said primary marginal side regions of said face regions.

* * * * *

UNITED STATES PATENT AND TRADEMARK OFFICE

CERTIFICATE OF CORRECTION

PATENT NO. : 5,411,203

DATED : May 2, 1995

INVENTOR(S) : Bochet, et al

It is certified that error appears in the above-indentified patent and that said Letters Patent is hereby corrected as shown below:

On title page, after item [22], should read as follows:
—Division of Ser. No. 861,795, filed as PCT/FR91/00433, May 30, 1991, Patent No. 5,356,069—.

On the cover page under heading Attorney, Agent or Firm "Mentilik" should read --Mentlik--.

Column 4, line 44, "Gold" should read --fold--.

Column 5, line 43, "a" should read --21a--.

Column 7, line 22, "49d" should read --40d--.

Signed and Sealed this

Seventh Day of November, 1995

Bruce Lehman

BRUCE LEHMAN

*Commissioner of Patents and Trademarks*

*Attest:*

*Attesting Officer*